United States Patent [19]

Poker, Jr.

[11] 4,110,921

[45] Sep. 5, 1978

[54] BUCKET CUTTING EDGE

[75] Inventor: John M. Poker, Jr., Oswego, Ill.

[73] Assignee: Caterpillar Tractor Co., Peoria, Ill.

[21] Appl. No.: 834,742

[22] Filed: Sep. 19, 1977

[51] Int. Cl.[2] ..... E02F 3/00

[52] U.S. Cl. ..... 37/141 R; 29/446; 29/DIG. 48; 172/719

[58] Field of Search ..... 37/141 R, 141 T, 118; 29/446, DIG. 48, DIG. 49; 172/719

[56] References Cited

U.S. PATENT DOCUMENTS

| | | | |
|---|---|---|---|
| 3,478,449 | 11/1969 | Baker | 37/141 R |
| 3,775,879 | 12/1973 | Quick | 37/118 R |
| 3,845,870 | 11/1974 | Balderson et al. | 37/118 A |
| 3,947,982 | 4/1976 | Mantovani | 37/141 R |
| 3,984,928 | 10/1976 | Oke et al. | 37/141 R |
| 3,995,384 | 12/1976 | Wood | 37/141 R |
| 4,009,529 | 3/1977 | Johnson | 37/141 R X |
| 4,043,060 | 8/1977 | Stepe | 37/141 R |

FOREIGN PATENT DOCUMENTS

| | | | |
|---|---|---|---|
| 69,773 | 11/1969 | German Democratic Rep. | 37/141 R |
| 92,888 | 9/1958 | Norway | 37/141 R |
| 859,910 | 1/1961 | United Kingdom | 37/141 R |
| 1,380,828 | 1/1975 | United Kingdom | 37/141 T |
| 168,195 | 3/1965 | U.S.S.R. | 37/118 R |

*Primary Examiner*—E. H. Eickholt

*Attorney, Agent, or Firm*—Wegner, Stellman, McCord, Wiles & Wood

[57] ABSTRACT

An improved cutting edge for use with a bucket having a front edge. The cutting edge is welded to the bucket and includes a rear portion having a hardness less than the front cutting edge portion to permit the assembly of the front and rear portions to be welded to the bucket front edge without preheating the cutting edge assembly and effecting the weldment thereto. In one form, the front portion of the cutting edge assembly is defined by a one-piece element, and in another form, the front portion includes a plurality of hardened blade elements welded to the rear portion.

14 Claims, 6 Drawing Figures

FIG. 1
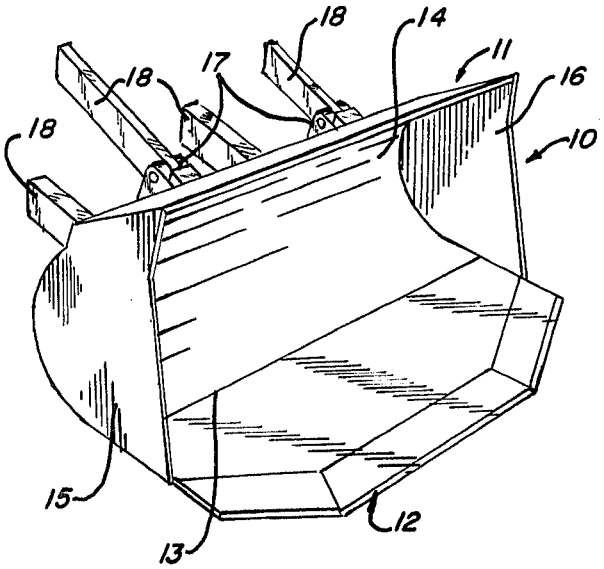
FIG. 6
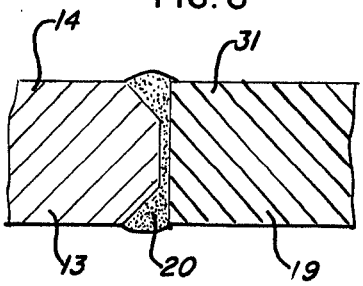
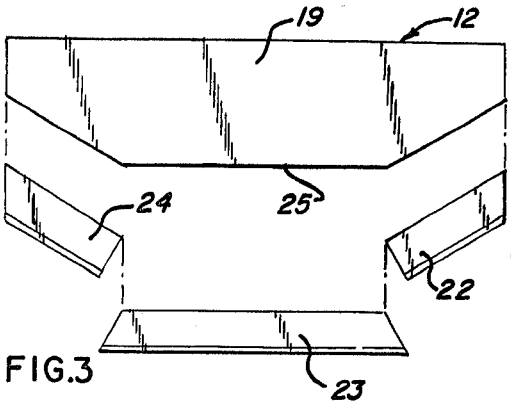
FIG.3
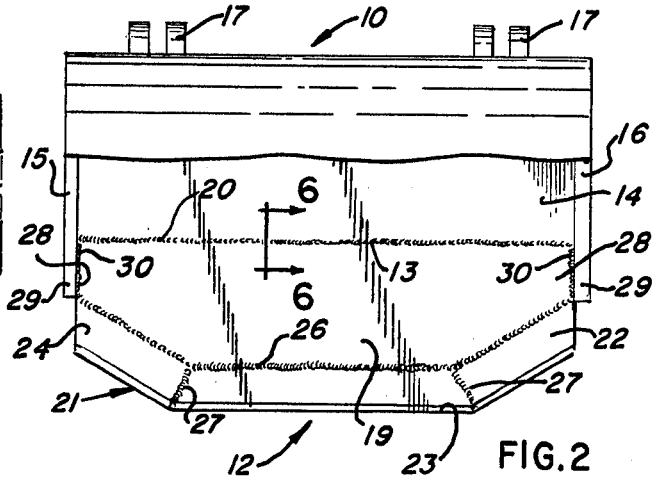
FIG.2
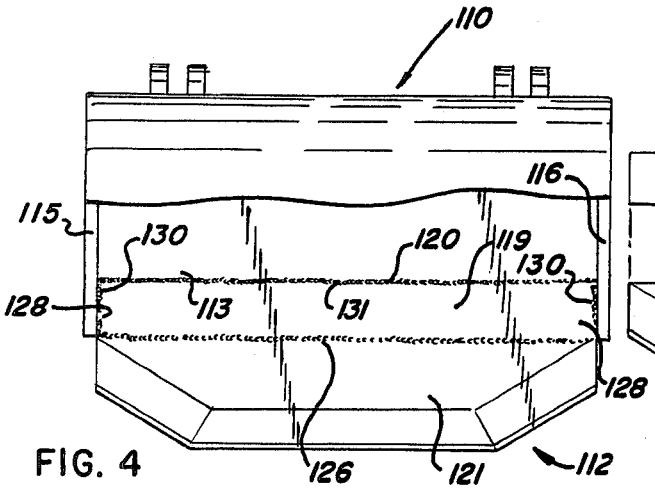
FIG. 4
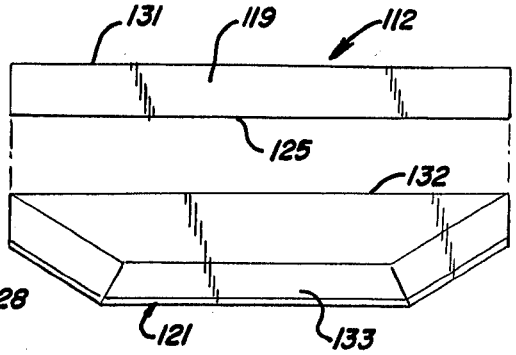
FIG. 5

BUCKET CUTTING EDGE

BACKGROUND OF THE INVENTION

1. Field of the Invention

This invention relates to bucket assemblies, and in particular to a cutting edge assembly and method of welding the cutting edge assembly to the bucket.

2. Description of the Prior Art

It is conventional in the use of loader buckets to provide a front cutting edge portion which is removable from the main body of the bucket as for replacement thereof upon occurrence of wear of the cutting edge. In one form of such a bucket assembly, the cutting edge is welded to the front edge of the bucket.

Such cutting edge structures are desirably formed of hardened steel so as to provide optimum wear characteristics. The welding of such hardened steel elements to the bucket requires a preheating operation. Such welding of the preheated cutting edge often results in a distortion of the assembly upon cooling thereof and, thus, has heretofore presented a serious problem in the formation of such loader bucket structures.

SUMMARY OF THE INVENTION

The present invention comprehends an improved bucket assembly and method of forming the same wherein a cutting edge assembly is preformed so as to provide a rear portion of non-heat treated material adapted to be welded to the front edge of the bucket for effectively precluding the undesirable distortion of the bucket assembly which has occurred, as discussed above, where the cutting edge assembly must be preheated at the time of assembly to the bucket.

More specifically, the invention comprehends such a bucket assembly wherein the cutting edge assembly has a front hardened portion and a rear portion having a hardness substantially less than that of the front portion. The front portion is secured to the rear portion to define a prefabricated assembly. During such prefabrication, the front portion may be preheated. Any distortion which may occur upon completion of this prefabrication may be eliminated by suitable straightening of this subassembly prior to the welding of the assembly to the bucket front edge.

In one form of the invention, the cutting edge assembly comprises a rear portion having a plurality of individual cutting edge elements welded to the front edge thereof. In another form of the invention, the cutting edge assembly is defined by a soft rear portion and a single hardened portion defining a plurality of front cutting edge sections.

The invention further comprehends that the side edges of the rear portion of the cutting edge assembly be welded to the sidewalls of the bucket. Thus, in the illustrated embodiment, the front cutting edge section of the cutting edge assembly may be disposed forwardly of the sidewalls.

In the illustrated embodiment, the front edge of the bucket is disposed rearwardly of the forwardmost portion of the sidewalls so that the rear portion of the cutting edge assembly extends between the sidewalls with the side edges thereof being welded to the sidewalls as discussed above.

Thus, the invention comprehends an improved bucket assembly eliminating the undesirable distortion of the bucket assembly as has occurred in the prior art constructions. The invention further comprehends an improved method of forming such a bucket assembly. The assembly and method of forming the same are extremely simple and economical and, thus, provide a highly meritorious improvement in the bucket assembly art.

BRIEF DESCRIPTION OF THE DRAWING

Other features and advantages of the invention will be apparent from the following description taken in connection with the accompanying drawing wherein:

FIG. 1 is a perspective view of a bucket assembly embodying the invention;

FIG. 2 is a fragmentary top elevation thereof;

FIG. 3 is an exploded plan view of the cutting edge assembly thereof;

FIG. 4 is a fragmentary top elevation of a modified form of bucket assembly embodying the invention;

FIG. 5 is an exploded view of the cutting edge assembly thereof; and

FIG. 6 is a fragmentary enlarged vertical section taken substantially along the line 6—6 of FIG. 2 illustrating one form of welding of the cutting edge assembly to the front edge of the bucket.

DESCRIPTION OF THE PREFERRED EMBODIMENTS

In the exemplary embodiment of the invention as disclosed in FIGS. 1–3 and 6 of the drawing, a bucket assembly generally designated 10 is shown to include a bucket portion thereof generally designated 11, and a cutting edge assembly generally designated 12. The invention comprehends an improved arrangement of the assembly 10 eliminating undesirable distortion and buckling of the assembly as has occurred in the prior art as a result of the need for preheating of the cutting edge in the welding thereof to the bucket front edge.

More specifically, bucket 11 defines a front edge 13 at the lower end of a rear wall 14. The bucket further defines a right sidewall 15 and a left sidewall 16 which extend to forwardly of the front edge 13, as seen in FIG. 1.

The rear wall 14 of the bucket may be provided with suitable mounting means, such as mounting means 17, for connection thereto of suitable arms 18 for controlling the disposition of the bucket in use. In such use, the bucket is conventionally urged along a ground surface so as to scoop material therefrom into the bucket. In conducting such a scooping operation, the cutting edge assembly 12 is utilized to cut through the ground material for delivery into the bucket and subsequent disposition thereof. The present invention is concerned with providing an improved cutting edge assembly for facilitated replaceable installation thereof in the bucket assembly 10.

More specifically as seen in FIGS. 2 and 3, the cutting edge assembly 12 may include a rear portion 19 which is adapted to be secured to the front edge 13 of the bucket wall 14 by a suitable weld 20. A front portion generally designated 21 of the cutting edge assembly is defined by a plurality of elements 22, 23 and 24 which comprise hardened cutting elements formed of a suitable material, such as steel. As shown in FIG. 2, elements 22, 23 and 24 are welded to the front edge 25 of the rear portion 19 by a suitable weld 26 and are welded to each other by suitable welds 27.

To effect such welding of the elements 22, 23 and 24 to the cutting edge assembly rear portion 19, the elements are preferably preheated and, thus, upon completion of the welds 26 and 27, some distortion of the assembly 12 may occur. Such distortion may be readily eliminated by a suitable straightening of the assembly by conventional means well known to those skilled in the art. Thus, the assembly 12 may then be readily welded to the bucket edge 13, as discussed above, without requiring any further preheating of the cutting edge assembly, permitting the cutting edge assembly to be installed in the bucket assembly 10 in an optimum manner.

As further illustrated in FIG. 2, the side edges 28 of the cutting edge assembly rear portion 19 may be welded to the front portions 29 of the sidewalls 16 by suitable welds 30. Here again, no preheating of the cutting edge assembly is required and, thus, distortion of the bucket assembly in the forming thereof is effectively eliminated.

As shown in FIG. 6, the rear edge 31 of the cutting edge assembly rear portion 19 may be welded to the front edge 13 of the bucket wall 14 by a double fillet weld 20 providing maximum strength while yet permitting facilitated replacement of the cutting edge assembly when desired. By eliminating distortion of the elements of the bucket assembly at the weld 20, an improved weld is obtained providing improved strength and long life.

Referring now to the embodiment of FIGS. 4 and 5, a modified form of bucket assembly generally designated 110 is shown to utilize a modified form of cutting edge assembly generally designated 112.

As more specifically shown in FIG. 5, the cutting edge assembly 112 is generally similar to cutting edge assembly 12 but utilizes a rear portion 119 having a rectilinear front edge 125. The front portion 121 of the cutting edge assembly comprises a one-piece unit having a rear edge 132 and a front cutting edge portion 133 having a configuration generally similar to the configuration of the elements 22, 23 and 24 of the cutting edge assembly 12 in the installed arrangement thereof as shown in FIG. 2.

In assembling the front portion 121 of the cutting edge assembly 112 to the rear portion 119 thereof, the front portion is preheated to permit an optimum welding of the rear edge 132 of portion 121 to front edge 125 of rear portion 119. Here again, if any distortion occurs as a result of the welding operation, the cutting edge assembly 112 may be readily straightened by suitable means prior to the installation of the assembly in the bucket assembly 110.

Referring now to FIG. 4, it may be seen that the front portion 121 of the cutting edge assembly is secured to the rear portion 119 thereof by the weld 126, and the rear edge 131 of the rear portion 119 is secured to the front edge 113 of the bucket by a suitable weld 120. As in bucket assembly 10, the side edges 128 of the rear portion 119 are secured to the sidewalls 115 and 116 of the bucket by suitable welds 130 to complete the assembly of the cutting edge subassembly to the bucket in forming the bucket assembly 110.

Thus, the present invention comprehends an improved method of forming a bucket assembly wherein the front cutting edge of a cutting edge assembly is provided therein prior to the securing of the cutting edge assembly to the bucket by means of a weld eliminating the need for preheating the cutting edge assembly in this final assembly operation. Thus, the cutting edge assembly may be suitably straightened subsequent to any distortion which may occur in welding the relatively hard cutting edge portion of the cutting edge assembly to the relatively soft rear portion thereof so that the final assembly is effectively distortion-free, thereby providing an improved resultant bucket assembly structure in a novel and simple manner.

The foregoing disclosure of specific embodiments is illustrative of the broad inventive concepts comprehended by the invention.

The embodiments of the invention in which an exclusive property or privilege is claimed are defined as follows:

1. In a bucket assembly having a bucket portion defining a front edge adapted to have a cutting edge welded thereto, the improvement comprising:

a cutting edge assembly having a front, hardened portion, a rear portion having a hardness less than that of the front portion, said front portion being welded to said rear portion and subsequently straightened to define a prefabricated assembly effectively free of welding distortion; and weld means securing said rear portion of the prefabricated straightened cutting edge assembly to said front edge of the bucket free of distortion of the bucket assembly as the result of the elimination of need for preheating of the cutting edge assembly in welding said prefabricated assembly to said cutting edge.

2. The bucket assembly of claim 1 wherein said front portion comprises a plurality of hardened blade elements welded to said rear portion.

3. The bucket assembly of claim 1 wherein said front portion comprises a plurality of hardened blade elements welded to said rear portion and to each other.

4. The bucket assembly of claim 1 wherein said front portion comprises a one-piece element.

5. The bucket assembly of claim 1 wherein said front portion comprises a one-piece element having a nonrectilinear front cutting portion.

6. The bucket assembly of claim 1 wherein said bucket portion further defines side edge portions and said cutting edge assembly further includes weld means securing said rear portion to said side edge portions.

7. The bucket assembly of claim 1 wherein said bucket portion further defines side edge portion and said cutting edge assembly further includes weld means securing said rear portion to said side edge portions along the entire length of the side edges of the rear portion between said first named weld means and said front portion of the cutting edge assembly.

8. The method of forming a bucket assembly comprising the steps of:

providing a bucket portion having a front edge adapted to have a cutting edge welded thereon;

preheating a front hardened cutting edge portion;

welding the preheated front hardened cutting edge portion to a rear cutting edge portion having a hardness substantially less than that of the front cutting edge portion to define a prefabricated cutting edge assembly;

straightening the prefabricated cutting edge assembly; and welding said rear cutting edge portion of the straightened prefabricated assembly to said bucket portion front edge without preheating of said cutting edge rear portion;

9. The method of forming a bucket assembly of claim 8 wherein said front cutting edge portion comprises a plurality of cutting edge elements individually welded to said rear portion.

10. The method of forming a bucket assembly of claim 9 wherein said front cutting edge portion includes a rear connecting portion and a plurality of front cutting edge elements first preheated and subsequently individually welded to said rear connecting portion, said rear connecting portion being welded to said rear cutting edge portion.

11. The method of forming a bucket assembly of claim 9 wherein said front cutting edge portion includes a rear connecting portion and a one-piece element defining a plurality of cutting edges, said element being first preheated and then welded to said rear connecting portion.

12. The method of forming a bucket assembly of claim 9 wherein said bucket portion further defines side edge portions and said method further includes the step of welding said rear cutting edge portion to said bucket side edge portions without preheating of said rear cutting edge portion.

13. The method of forming a bucket assembly of claim 9 wherein said front cutting edge portion includes a rear connecting portion and a plurality of front cutting edge elements firstly preheated and subsequently individually welded to said rear connecting portion, said rear connecting portion being welded to said rear cutting edge portion, said bucket further defining side edge portions and said method further including the step of welding said rear cutting edge portion to said bucket side edge portions without preheating of said rear cutting edge portion.

14. The method of forming a bucket assembly of claim 9 wherein said front cutting edge portion includes a rear connecting portion and a one-piece element defining a plurality of cutting edges, said element being first preheated and then welded to said rear connecting portion, said bucket further defining side edge portions and said method further including the step of welding said rear cutting edge portion to said bucket side edge portions without preheating of said rear cutting edge portion.

* * * * *